US005154332A

United States Patent [19]

Williams et al.

[11] Patent Number: 5,154,332

[45] Date of Patent: Oct. 13, 1992

[54] ENCLOSURE FOR BACK-CARRIED EQUIPMENT

[76] Inventors: C. Wyatt Williams; Ellen Williams, both of P.O. Box 11067, Oakland, Calif. 94611-1067

[21] Appl. No.: 692,266

[22] Filed: Apr. 26, 1991

[51] Int. Cl.[5] ..... A45F 4/02; A45C 13/30

[52] U.S. Cl. ..... 224/153; 190/26

[58] Field of Search ..... 224/153, 151, 209; 150/104, 154; 190/26

[56] References Cited

U.S. PATENT DOCUMENTS

| | | | |
|---|---|---|---|
| 3,316,951 | 5/1967 | Jacobson | 224/151 X |
| 4,066,195 | 1/1978 | Dickler | 224/153 |
| 4,085,873 | 4/1978 | Schweitzer | 224/153 X |
| 4,449,655 | 5/1984 | Germe | 224/153 |
| 4,563,777 | 1/1986 | Park | 2/108 |
| 4,673,117 | 6/1987 | Calton | 224/151 |
| 4,752,263 | 6/1988 | Pritchard et al. | 441/88 |
| 4,940,173 | 7/1990 | Jacober | 224/151 |

FOREIGN PATENT DOCUMENTS

| | | | |
|---|---|---|---|
| 2221833 | 2/1990 | United Kingdom | 224/153 |

*Primary Examiner*—Henry J. Recla
*Assistant Examiner*—David J. Walczak
*Attorney, Agent, or Firm*—McCubbrey, Bartels, Meyer & Ward

[57] ABSTRACT

A multifunctional enclosure for back-carried equipment. When used with equipment that provides a harness for carrying the equipment on a user's back, this enclosure provides a number of features relating to the transportation, storage and usage of the equipment. When used as an enclosure for a backpack, the backpack is inserted into the enclosure and the contents are transported by means of a handle or shoulder strap in a manner similar to a duffel bag. Whenever the backpack must be left unattended for any period of time, a padlock can be used to interconnect the zippers to prevent the zippers from being unzipped. For additional security, a metal cable can be used to secure the invention and enclosed backpack to an an immobile object. This feature allows the traveler to leave the backpack unattended for short periods of time without the fear of theft of the contents or the backpack itself. Furthermore, the orientation of the zippers allows the backpack to be worn by the user while the backpack is inside the enclosure. A removable flap of material provides a passageway for the shoulder straps of the backpack to pass through the enclosure and to be worn by the user, allowing the enclosure to serve as an all-purpose protective cover from the elements of weather.

18 Claims, 10 Drawing Sheets

ENCLOSURE FOR BACK-CARRIED EQUIPMENT

FIELD OF INVENTION

This invention relates to equipment that is carried on a user's back by means of a harness. Outdoor sporting gear, and in particular backpacks are examples of this type of equipment.

BACKGROUND

As a result of the increasing interest in the environment, more and more individuals are exploring the wilderness. While some of these individuals are content to explore their own backyards, others journey into more remote regions of the world. These journeys can range from a few weeks to many months in duration.

Heretofore, individuals traveling on these journeys encountered a number of logistical problems relating to their backpacks. For the typical journey, these backpackers must travel a long distance to get to where they begin their expedition (called the point of embarkation), and getting their backpacks to this point was difficult. Many transportation agencies (airline, train, bus, etc.) do not allow backpacks to be checked as baggage and those few that check backpacks do not guarantee the condition of the backpacks upon arrival at the destination. Some people use large duffel bags to solve this problem but encounter another problem upon arrival: the empty duffel bag. Once unpacked, they could carry the duffel bag with them which would be extra weight, throw the duffel bag away which would be wasteful, or give the duffel bag to someone to hold for the return trip which would be unlikely.

Another problem encountered by many backpackers is that they must keep their backpacks with them at all times. To leave them unattended for a few moments can result in the theft of the contents or the backpack itself. They must carry their backpacks into restaurants, museums, grocery stores, guided tours, etc. Though some travelers will put their backpacks in public lockers, lock them in hotel rooms, or leave them with a friend, these options are not always available.

Finally, for persons traveling in inclement weather or in rugged terrain, some means to protect the backpack and the gear inside the backpack from rain, snow, mud, etc. is desirable. Rain shells for backpacks provide this function but the extra weight is only justified when the weather is poor.

OBJECTS AND ADVANTAGES

Accordingly, several objects and advantages result from this invention when used with back-carried equipment. An object of this invention is to provide a means for transporting such equipment as baggage.

Another object of this invention is to provide a means for reasonably securing such equipment and its contents when it is necessary to leave the equipment unattended.

A further object of this invention is to provide a means for protecting such equipment from the elements of weather and terrain when the equipment is in use.

Given the preferred embodiment as backpack enclosure, the following paragraphs highlight the advantages of the invention. Relating to the initial object, the invention functions in a manner similar to a duffel bag: the enclosure is unzipped, the backpack is inserted into the enclosure, the zippers are closed, and the enclosure and contents are transported by means of a handle.

Whenever the backpack must be left unattended for any period of time, a common padlock can be used to interconnect the zippers to prevent the zippers from being unzipped. For additional security, a metal cable can be used to secure the invention and enclosed backpack to an an immobile object. This feature allows the traveler to leave the backpack unattended for short periods of time without the fear of theft of the contents or the backpack itself.

Furthermore, the orientation of the zippers allows the backpack to be worn by the user while the backpack is inside the enclosure. A removable flap of material provides a passageway for the shoulder straps of the backpack to pass through the invention and to be worn by the user.

This feature provides two primary advantages over duffel bags. First, since the user travels with the backpack inside the invention, it allows the user to quickly and conveniently take off and reasonably secure the backpack. On the other hand, if a duffel bag were to be used to secure the backpack, the tedious process would involve taking off the backpack, locating the duffel bag somewhere inside the backpack, unzipping the duffel bag, inserting the backpack into the duffel bag, zipping closed the duffel bag and finally securing the duffel bag. In addition, the ability of a user to carry their backpack enclosed within the invention allows the invention to serve as an all-purpose protective cover from the elements of weather. Though common rain shells for backpacks provide this protective feature, they are limited in providing only this function.

Further objects and advantages of our invention will become apparent and will be more readily understood from a consideration of the attached drawings, taken together with the ensuing description of our invention.

LIST OF REFERENCE NUMERALS IN DRAWINGS

| | |
|---|---|
| 10- detachable connector device | 12- handle |
| 14a- zipper a | 14b- zipper b |
| 14c- zipper c | 16- invention/enclosure |
| 18- handle strap | 20- support strap |
| 22- tab | 24- slider/tab assembly |
| 26- front panel | 28- back panel |
| 30- bottom panel | 32- top panel |
| 34a- side panel a | 34b- side panel b |
| 36- zipper | 38- termination point of zipper |

-continued

| | |
|---|---|
| 40- origin point zipper | 42- flap of material |
| 44- cloth tie | 46- shackle |
| 48- padlock | 50- apparatus |
| 52- shoulder strap of backpack | 54- backpack frame |
| 56- weather flap | 58- backpack |
| 60- shoulder strap for enclosure | 62- hole in tab |
| 64- interior storage compartment | 66- exterior storage compartment |

DESCRIPTION OF PREFERRED EMBODIMENT OF THE INVENTION

Figure 1:
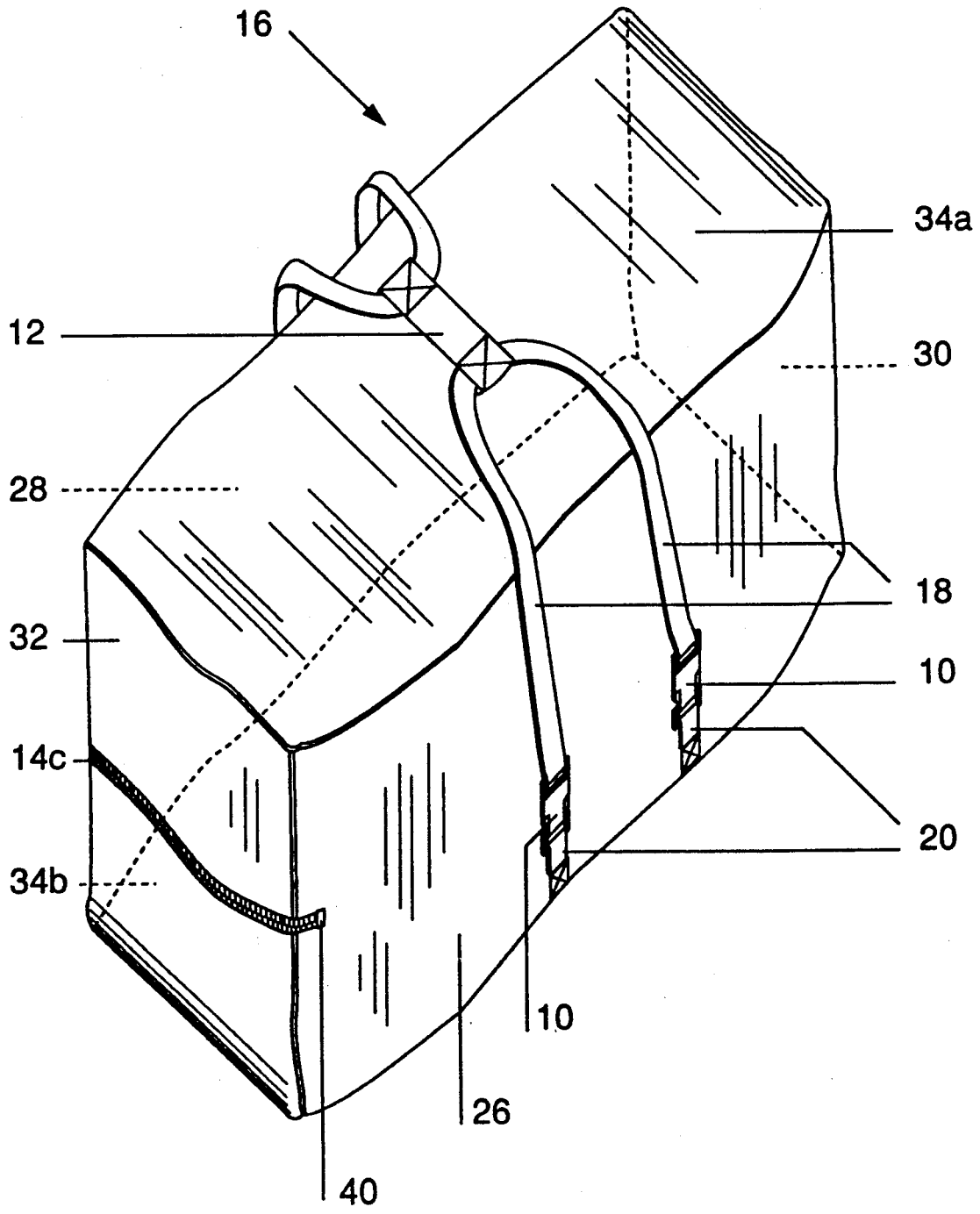
FIG. 1 is a perspective of the front side of the invention.
Figure 3:
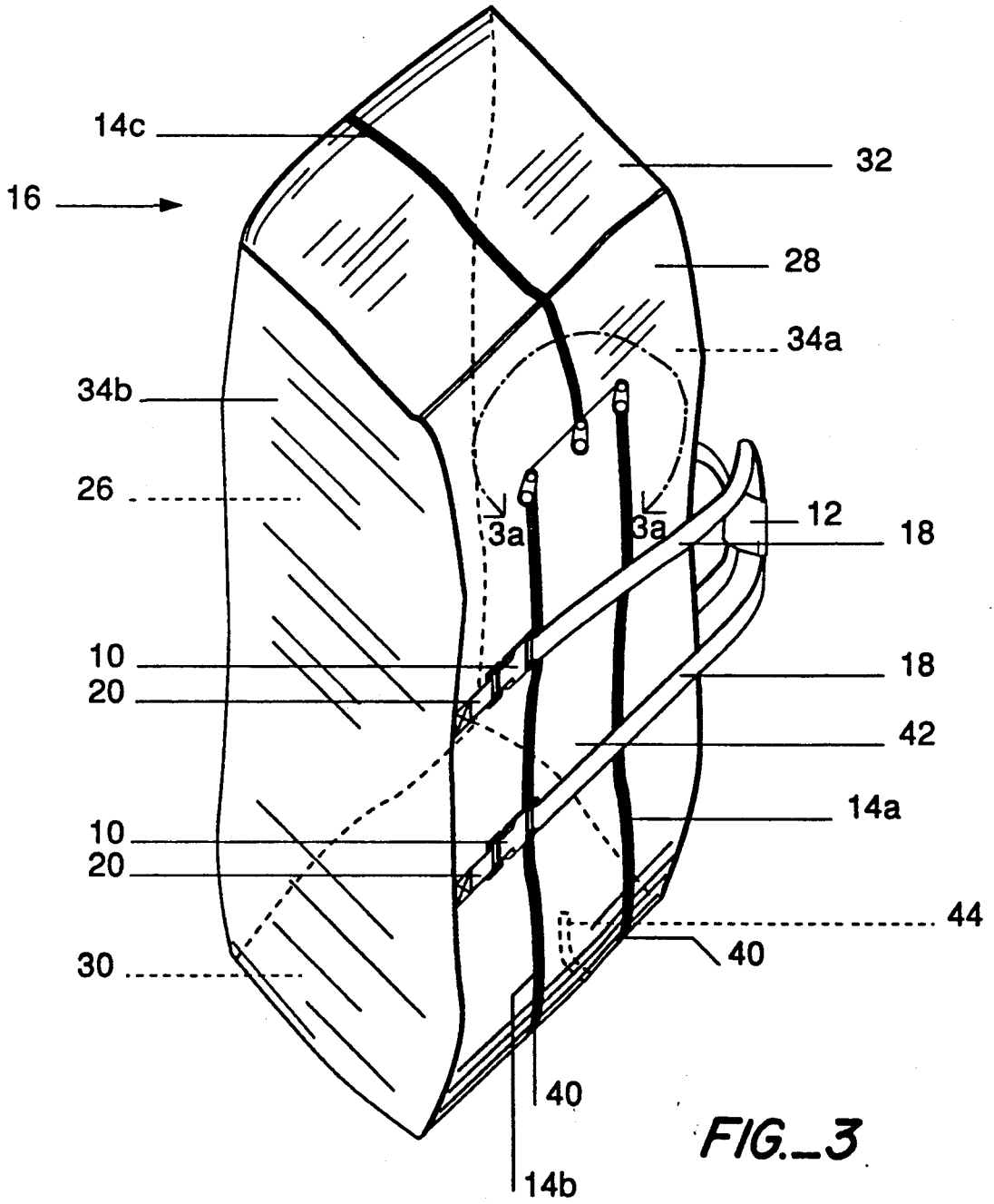
FIG. 3 is a detail of the invention with the zippers closed and interlocked.
Figure 3A:
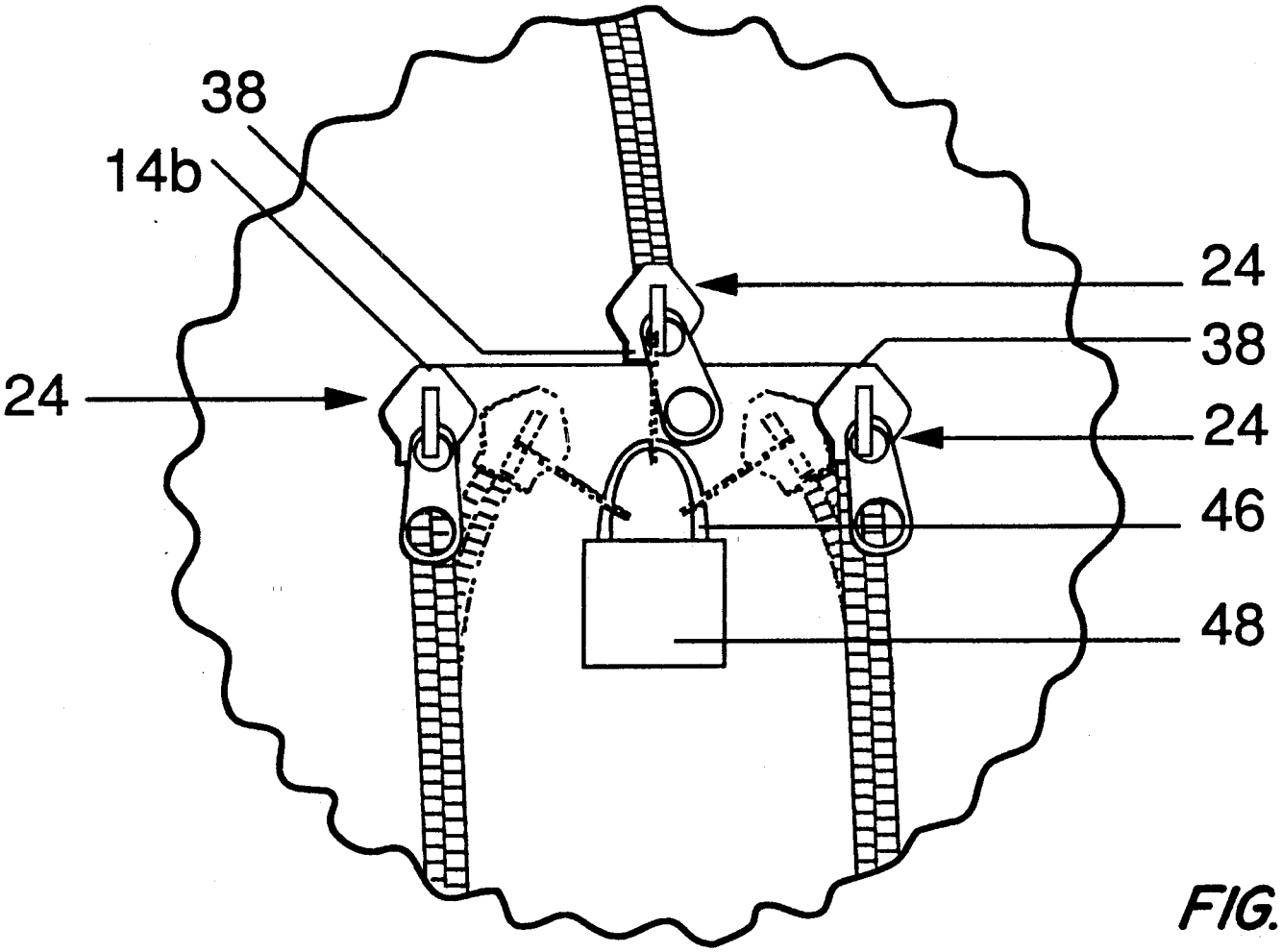

The preferred embodiment of the invention as illustrated in FIGS. 3 and 1 is a substantially rectangular fabric enclosure 16, for which there is a front panel 26, a back panel 28, two narrower side panels 34*a* and 34*b*, a top panel 32 and a bottom panel 30, each of which is connected along its mutually coincident edge by stitching, energy sealing or like means. In addition, the enclosure has three closure devices 14*a*, 14*b*, and 14*c*, and an attached handle 12. The closure devices are closed in order to join the split portions of the edge panels and thereby prevent the contents of the enclosure from passing out of the enclosure.

This embodiment of invention 16 uses zippers as the preferred closure devices. Referencing FIG. 2, the location of a slider/tab assembly 24 along a zipper 36 determines whether zipper 36 is opened or closed. When slider 24 is at an origin point 40, zipper 36 is open (or unzipped). When slider 24 is at a termination point 38, the zipper 36 is closed (or zipped). A tab 22 of slider 24 is constructed in such a way as to provide a hole 62 in tab 22 of sufficient diameter to allow an interlocking means, such as a shackle 46 of a padlock 48, to pass thru all tabs 22, as depicted in FIG. 3.

As shown in FIG. 3, zipper pair 14*a* and 14*b* are parallel to each other and are on back panel 28. There is a flap of material 42 between them that is secured to enclosure 16 at the intersection of back panel 28 and bottom panel 30. Zipper pair 14*a* and 14*b* are spaced apart at such a distance as to allow the harness, in this case a shoulder strap 52 of a backpack 58, to pass through invention 16 unencumbered when flap 42 is secured out of the way.

Figure 2:
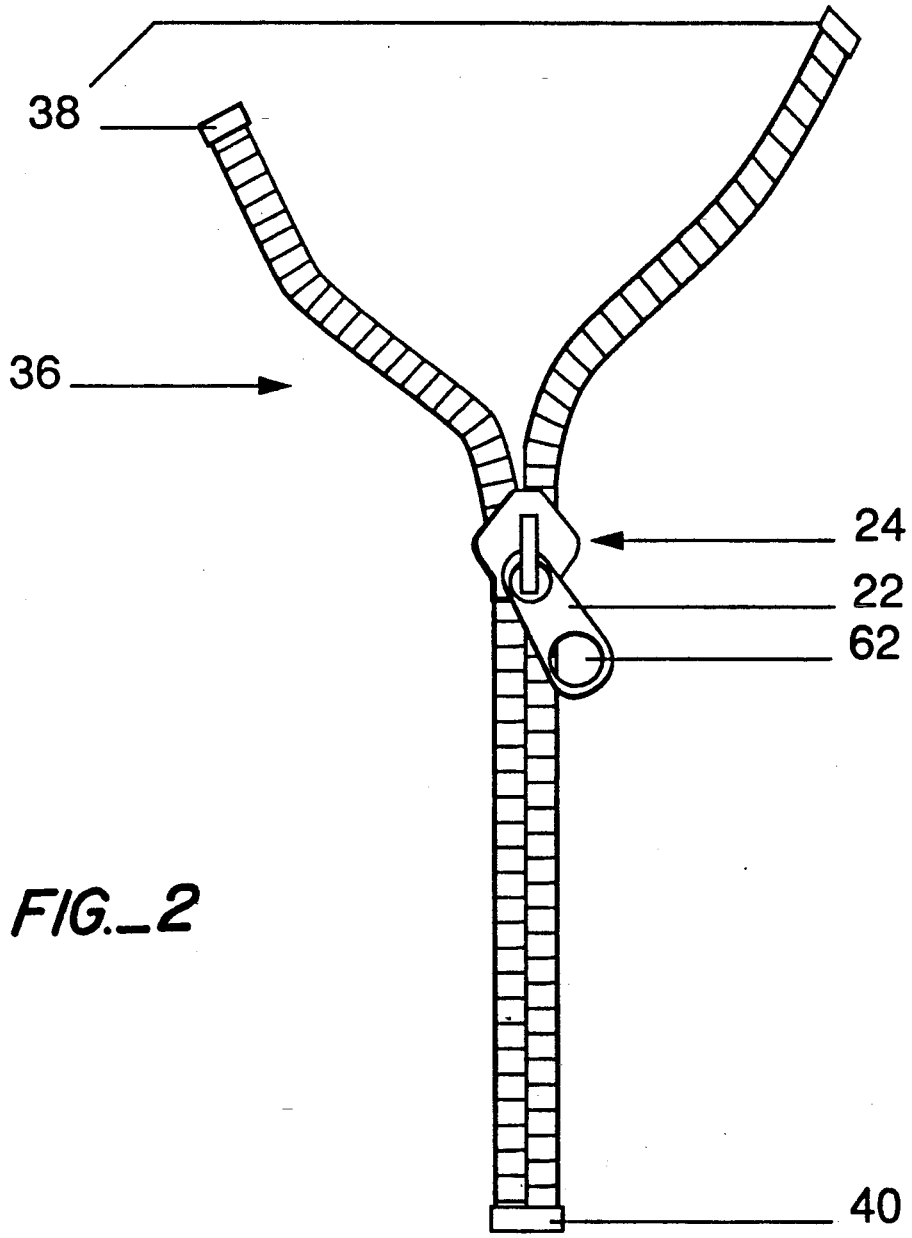
FIG. 2 is a plan view of a zipper.

Again referencing FIG. 2, sliders 24 of zippers 14*a* and 14*b* are at origin point 40 when the respective slider 24 is at the intersection of bottom panel 30 and back panel 28. Third zipper 14*c* originates on front panel 26, travels over top panel 32, and terminates between but just above termination point 38 of zippers 14*a* and 14*b* on back panel 28. Therefore, when all three zippers 14*a*, 14*b*, and 14*c* are closed, sliders 24 of each zipper 14*a*, 14*b*, and 14*c* are in close proximity of each other, as illustrated in FIG. 3.

Figure 9:
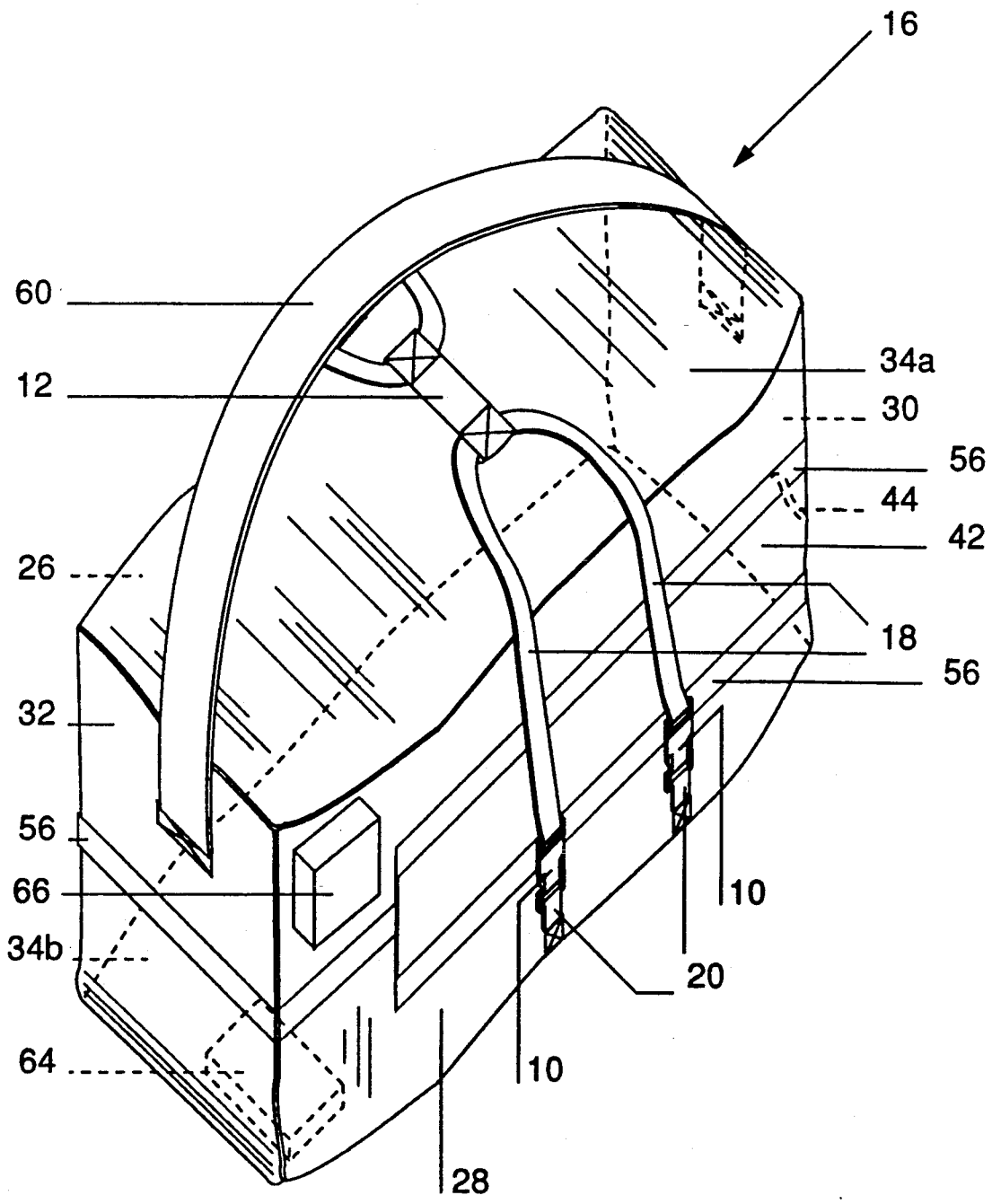
FIG. 9 is an alternative embodiment with protective flaps over the closure devices, a shoulder strap, and interior and exterior storage compartments.

If one or more zippers 36 used in construction of the invention does not provide an adequate weather barrier for backpack 58, then a means of providing such an adequate barrier can be used. One possible solution is to add a additional piece of material 56 along closure device as shown in FIG. 9. Other enhancements to the invention could take the form of one or more interior storage compartments 64, one or more exterior storage compartments 66 or a shoulder strap 60 as illustrated in FIG. 9.

The invention is preferably constructed of strong, durable materials which can endure repeated exposure to the elements of weather and rough handling. Both natural and man-made materials such as canvas and nylon are suitable for the panel material. The handles must support substantial weight and could be made of nylon, polypropylene, or canvas webbing.

OPERATION OF INVENTION

The design of this invention provides three primary features for back-carried equipment: 1) the ability to protect the equipment so that it may be checked as baggage for transportation; 2) the ability to enclose and reasonably secure the equipment both inside the enclosure and to an immobile object; and 3) the ability for it to be used as a protective shell for the equipment that is being carried on the user's back.

To use the first feature, invention 16 is oriented as in FIG. 3 such that back panel 28 is facing the user. Zippers 14*a*, 14*b*, and 14*c* are opened, backpack 58 is placed inside such that backpack 58 is upright and a frame 54 is closest to back panel 28. All zippers are closed. Invention 16 with enclosed backpack 58 is now placed on side panel 34*b* as depicted in FIG. 1. Backpack 58 can now be carried by means of handle 12 and can be checked as baggage.

To use the second feature, backpack 58 is inserted into the invention as in the first feature and all zippers are closed. Zippers 14*a*, 14*b*, and 14*c* can now be interlocked by Suitable means for interconnecting tabs 24 such as running shackle 46 of padlock 48 through each hole 62 of tabs 24 of each zipper respectively and locked as detailed in FIG. 3. The orientation of zippers 14*a*, 14*b*, and 14*c* prevent zippers 14*a*, 14*b*, and 14*c* from being unzipped when so interconnected.

For additional security, backpack 58 can be locked to an immobile object by using a cable with eyelets at each end. After interlocking zippers 14*a*, 14*b*, and 14*c*, the cable can be looped thru frame 54 of backpack 58 and around an immobile object, such as a lightpost, bike rack, etc. Shackle 46 can be threaded through the eyelet at each end of the cable and the padlock locked. This configuration has the dual effect of interconnecting the zippers and locking the backpack to an immobile object.

Figure 5:
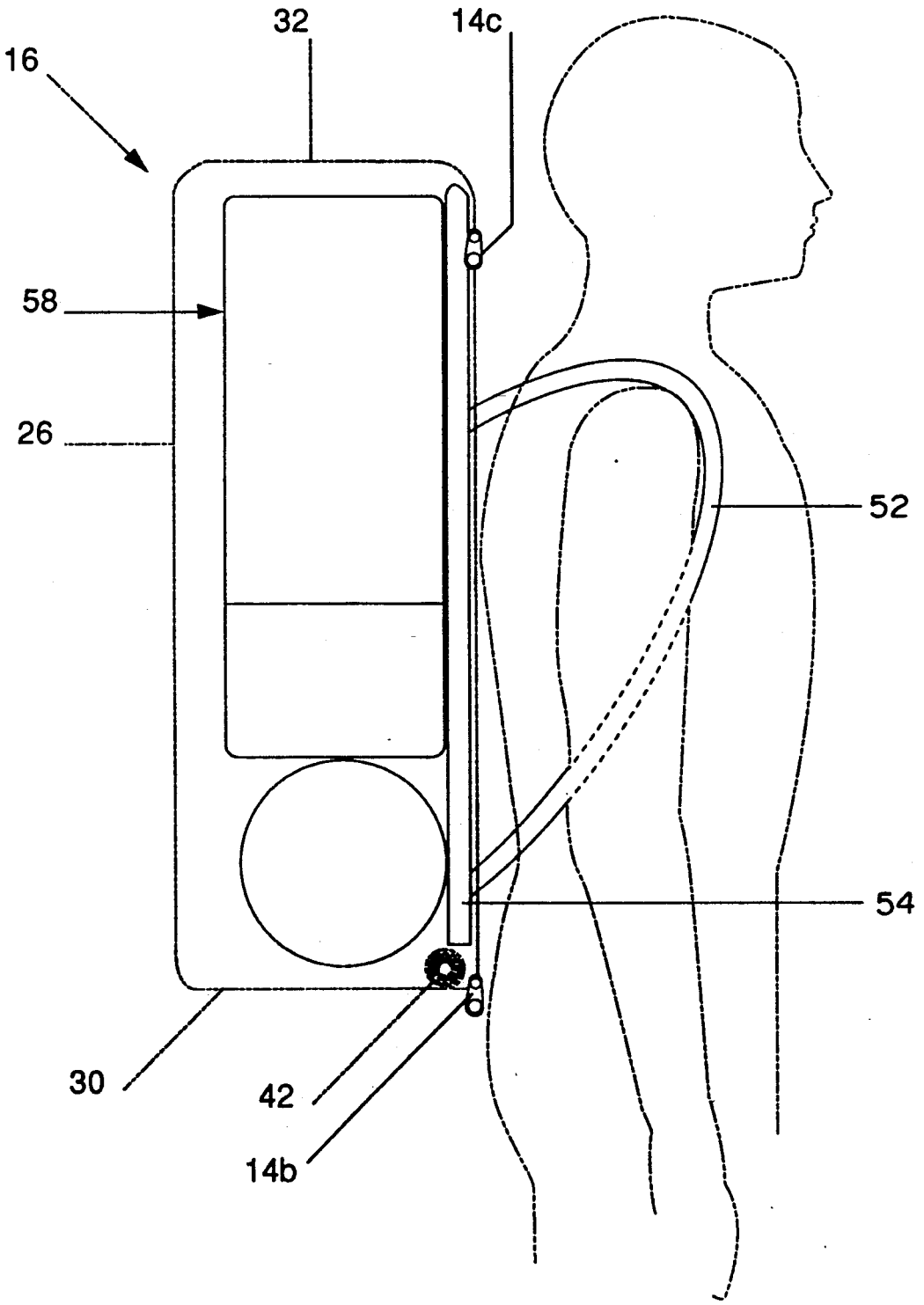
FIG. 5 is a plan view of a user carrying a backpack with the enclosure in place.

To use the third feature, backpack 58 is inserted into invention 16 as in the first feature but only top zipper 14*c* is closed-zipper pair 14*a* and 14*b* remain open. Resultant flap of material 42 between zipper 14*a* and 14*b* is capable of being rolled upon itself and secured in the rolled condition by means of a cloth tie 44. Cloth tie 44 is located at the intersection of back panel 28 and bottom panel 30, on the inside of enclosure 16. This permits a user to roll up flap 42 and secure it out of the way when it is desired to use the invention as a shell, as shown in FIG. 5.

Figure 4:
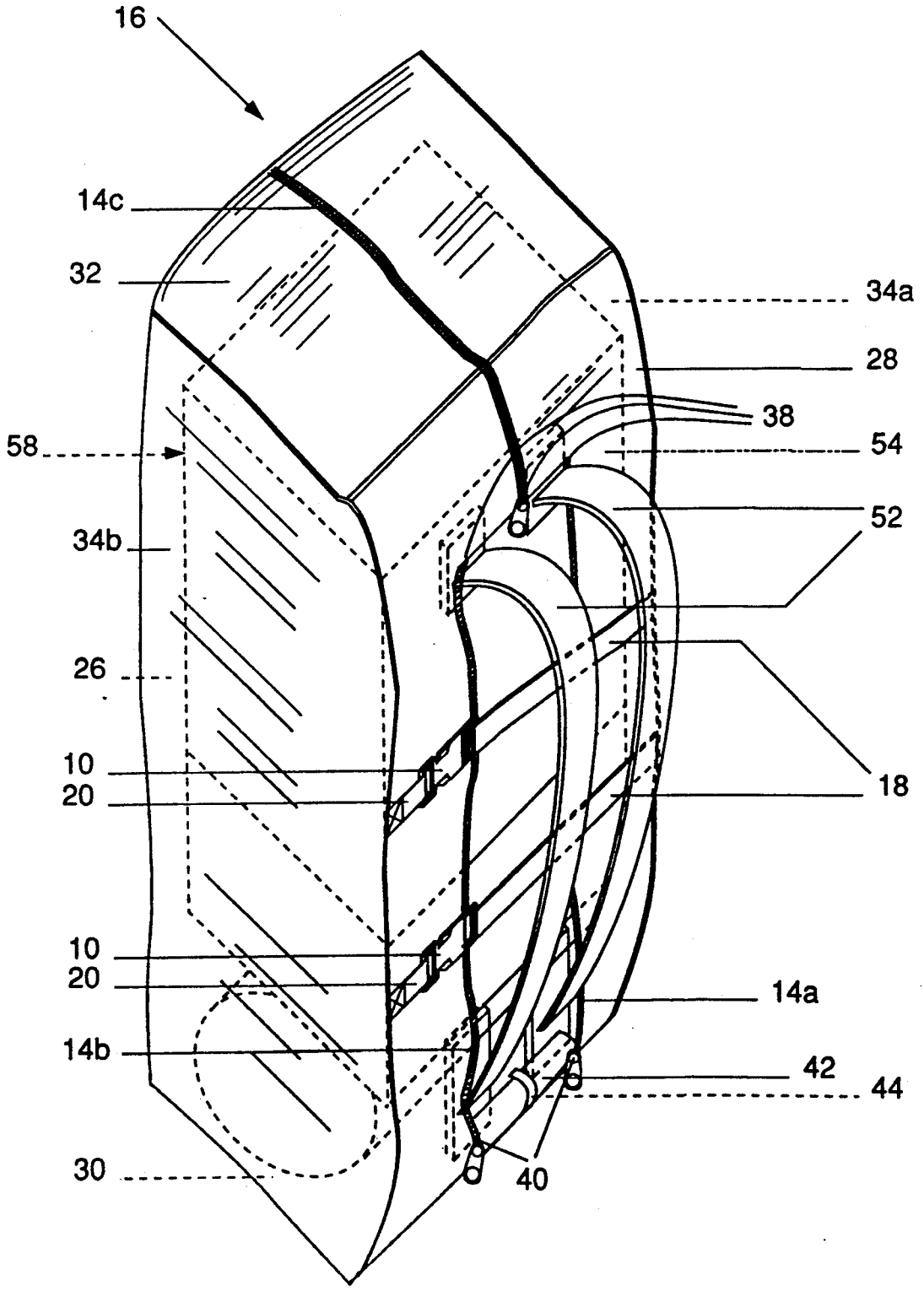
FIG. 4 is a perspective of the invention lashed to the backpack.

To lash enclosure 16 around backpack 58, each handle strap 18 at back panel 28 is disconnected from each respective support strap 20 by means of a connector device 10, as illustrated in FIG. 4. Both shoulder straps 52 of backpack 58 are pulled away from frame 54 and detached handle straps 18 are passed through the resultant opening between shoulder straps 52 and backpack frame 54. Handle straps 18 are reattached to supporting straps 20. This configuration secures the enclosure to the backpack due to the lashing effect of supporting straps 20 and allows the invention 16 to provide a protective barrier against the elements of weather.

Figure 6:
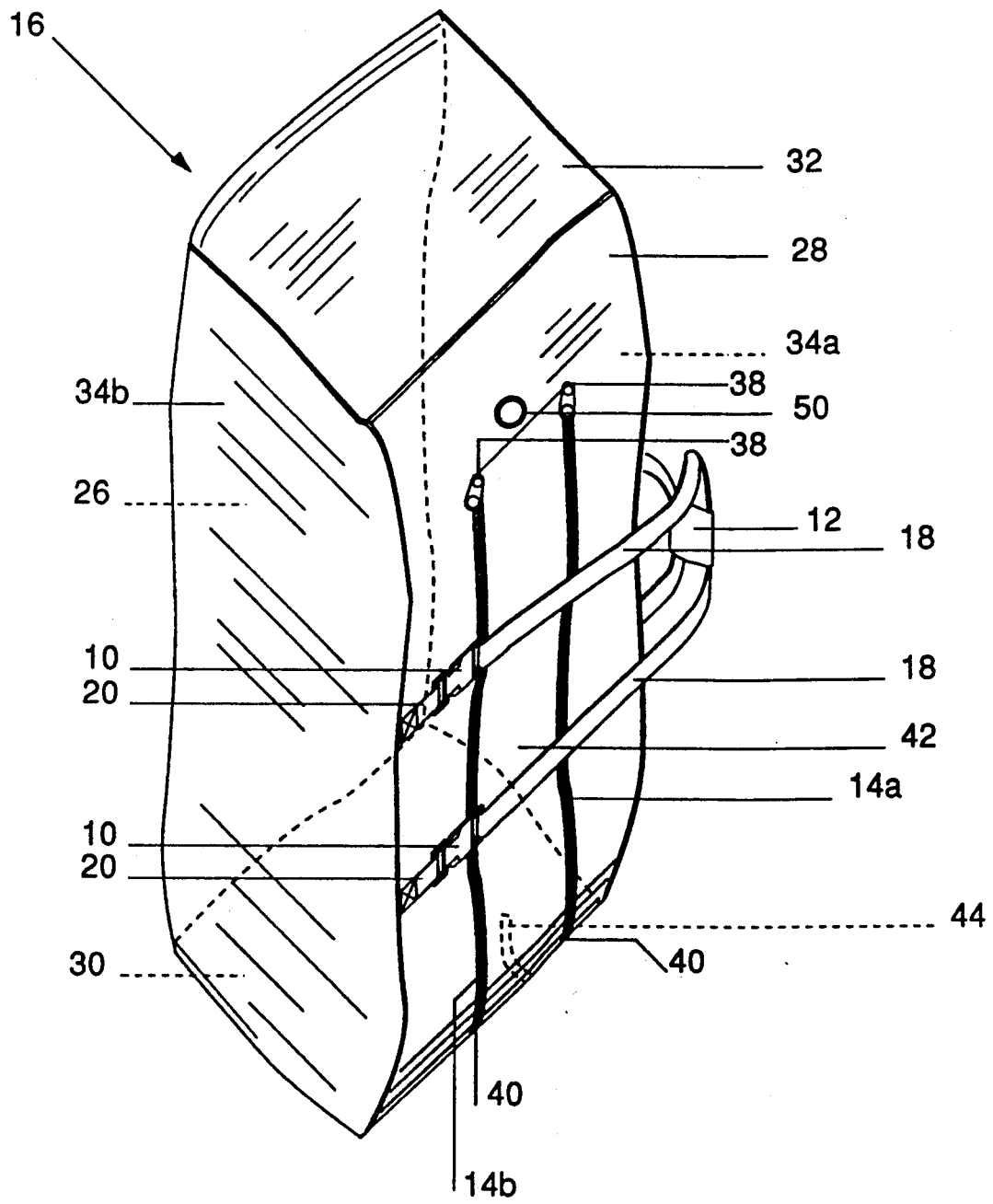
FIG. 6 is an alternative embodiment of the invention with two zippers and an annular device.

An alternative embodiment of invention 16 is shown in FIG. 6. This design uses only two zippers 14*a* and 14*b* and suitable securing means such as an apparatus 50 located near termination points 38. When zippers 14*a* and 14*b* are closed, an interlocking device is threaded through both tabs 22 and apparatus 50 and locked. There are any number of apparatuses 50 that can be located near termination point 38 in order to interlock zippers 14*a* and 14*b*. Such suitable apparatuses include rings, loops and other annular devices, buckles, hooks and tie downs.

Figure 7:
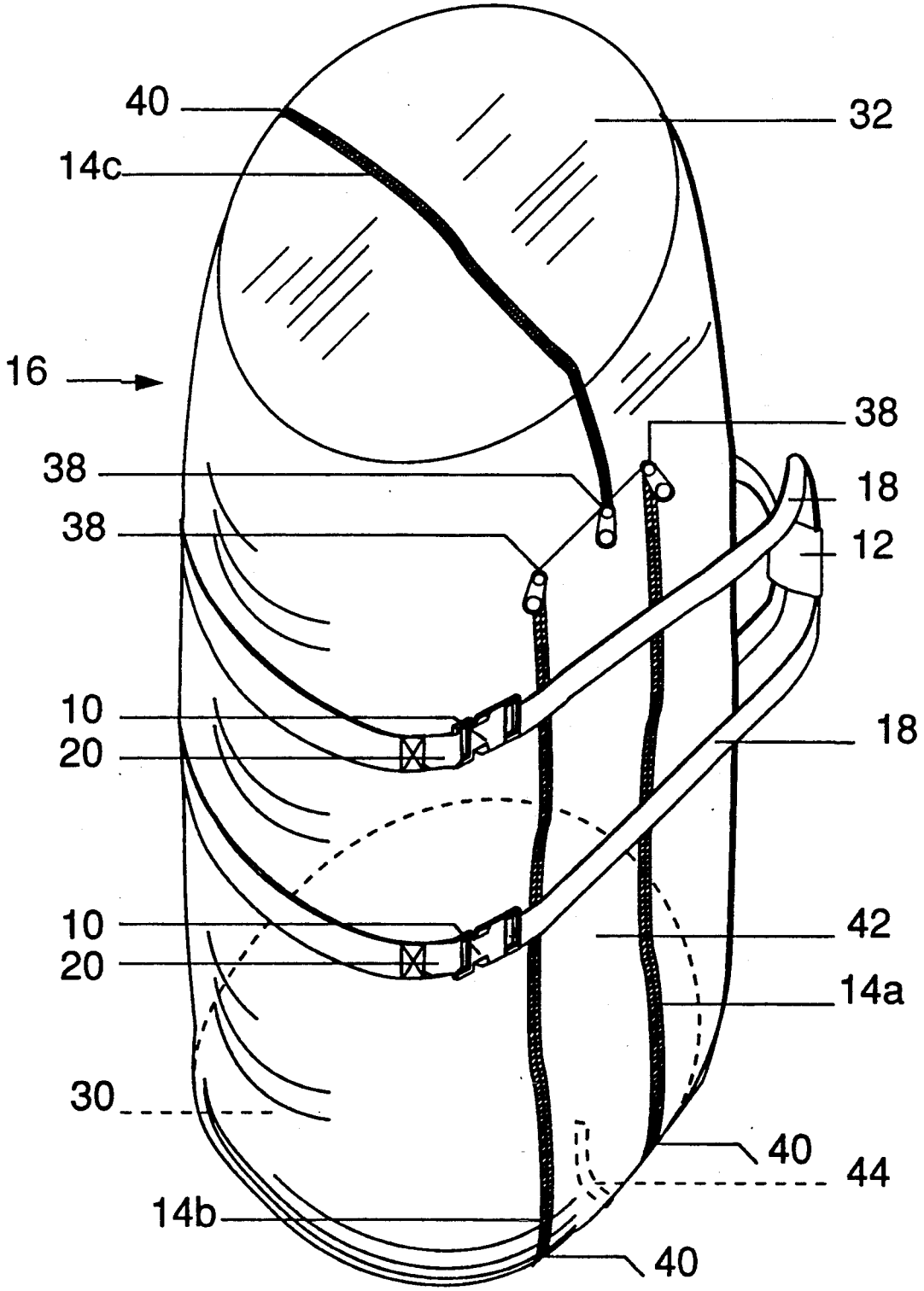
FIG. 7 is an alternative embodiment of the invention in a cylindrical enclosure

Another embodiment is illustrated in FIG. 7. This design uses the same closure device configuration as the preferred embodiment but uses a substantially cylindrical enclosure.

Figure 8:
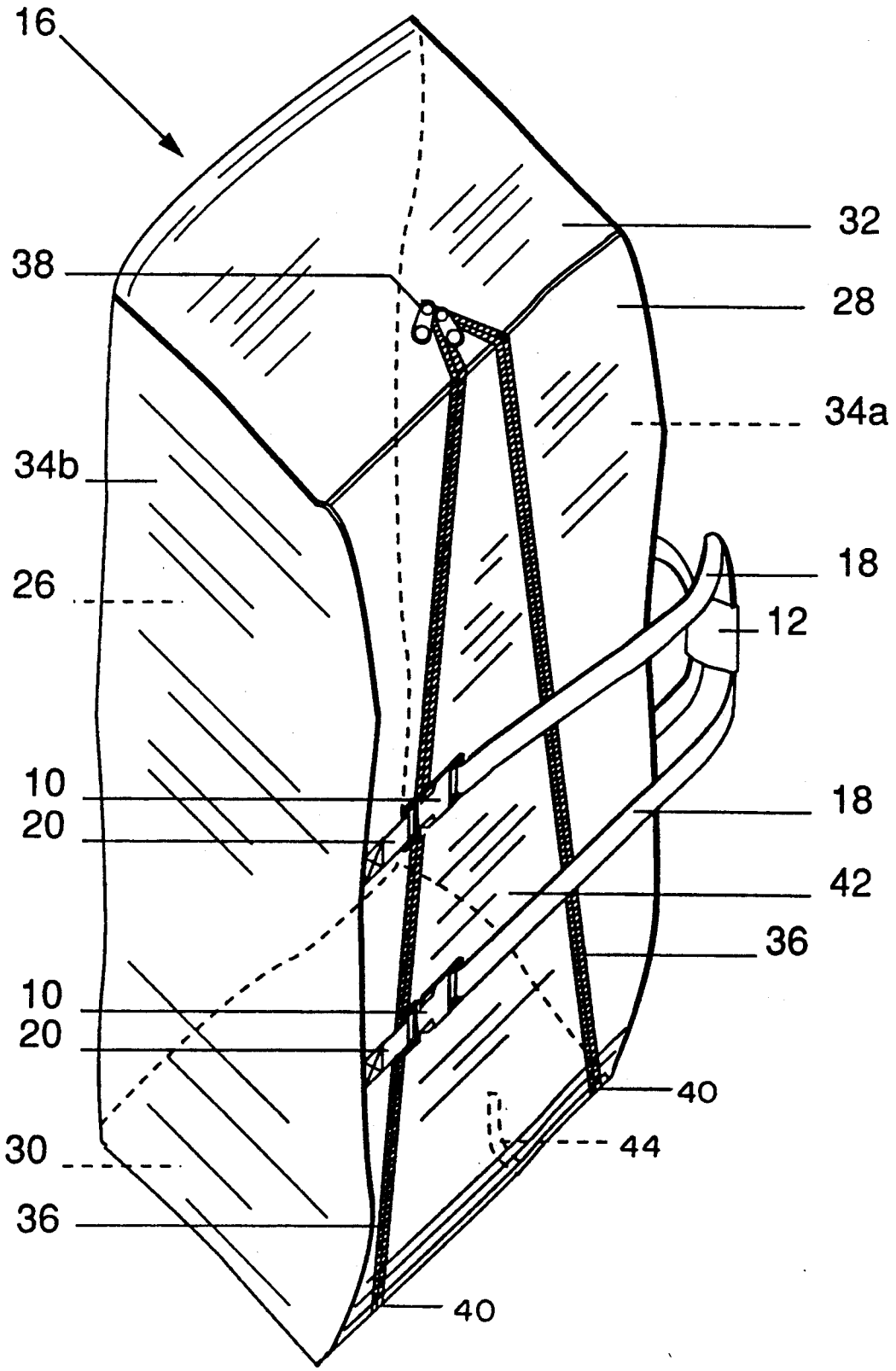
FIG. 8 is an alternative embodiment of the invention with zippers in an inverted V configuration.

Yet another embodiment shown in FIG. 8 orients the closure devices in an inverted V orientation.

Still another embodiment illustrated in FIG. 9 illustrates additional enhancements to the invention. Shown in the figure are shoulder strap 60, protective flaps 56 for the zippers 14*a*, 14*b* and 14*c*, inner storage compartment 64 and outer storage compartment 66.

Finally, other embodiments are possible and could include panels for which two or more panels are made from the same piece of material and therefore not connected along each edge. A closure device could be configured in a T orientation, with the base of the T comprises of 2 parallel closure devices. Another configuration might consist of a single closure device in an inverted U orientation. In addition, the connector devices 10 could be eliminated if the two sets of handle straps 18 could be disconnected at the handle 12.

CONCLUSION, RAMIFICATIONS, AND SCOPE OF INVENTION

This invention is a multifunctional enclosure for all types of back-carried equipment that uses a harness to support the equipment on the user's back. It permits the user to protectively enclose such equipment inside the invention to facilitate transportation on buses, trains, planes, etc. Also, the invention enables the user, when such equipment must be left unattended, to reasonably secure the equipment inside the protective enclosure and additionally to an immobile object by an interconnecting and interlocking means. Finally, the invention permits the invention to be used as a protective cover while the user is carrying the equipment on the user's back.

Since various possible embodiments might be made of the present invention or modifications might be set forth, it is to be understood that all of the materials shown and described in the accompanying drawings are to be interpreted as illustrative and not in a limiting sense. Accordingly, the scope of the invention should be determined not by the embodiments illustrated, but by the appended claims and their legal equivalents. Other modifications of the present invention are contemplated and can be resorted to by those skilled in the art, without departing from the spirit and scope of the invention as defined by the following claims.

I claim:

1. An enclosure device suitable for enclosing equipment having harness apparatus for carrying the equipment on a human back, comprising:

an enclosure element defining an interior cavity for receiving the equipment;

an elongated opening for providing access into said interior cavity being of a width for allowing unencumbered passage of the harness apparatus through said elongated opening when the equipment is received within said interior cavity so that the equipment can be supported on a human back by the harness;

an elongated flap portion movable between an open position whereby said elongated opening is exposed and a closed position for denying access into said interior cavity whereby said elongated opening is covered by said elongated flap portion; said elongated flap portion being defined by a segment of said enclosure having opposite longitudinal sides and closure device along each longitudinal side for allowing selective access into said interior cavity; said elongated flap adapted to be rolled into said opening, and means on said enclosure element for retaining said flap in said rolled position; and at least one lashing member oriented substantially transverse to said elongated opening and further oriented to traverse said closure devices for lashing said enclosure element around the equipment so that said enclosure element is secured to the equipment while said elongated flap portion is in said open position.

2. The enclosure device of claim 1, wherein said elongated flap portion is rectangular in shape having first and second substantially parallel longitudinal sides and first and second substantially parallel latitudinal sides; said first longitudinal side being defined by a first closure device of said at least one closure device and said second longitudinal side being defined by a second closure device of said at least one closure device, and said elongated flap being fixably attached to said enclosure element at said first latitudinal side so that said elongated flap can be moved to said open position while remaining fixedly attached to said enclosure device.

3. The enclosure device of claim 2 wherein said at least one lashing member is a strap detachably mounted to said enclosure element at a first lashing site proximate said first longitudinal side and attached to said enclosure element at a second lashing site on said enclosure device.

4. The enclosure device of claim 3 wherein said strap comprises means to support said enclosure at said first and second lashing sites for carrying the equipment by hand.

5. The enclosure device of claim 4 wherein said enclosure element is substantially rectangular in shape having narrow first and second elongated side panels, narrow top and bottom panels, an elongated back panel and an elongated front panel.

6. The enclosure device of claim 5 wherein said elongated opening is disposed on said elongated back panel.

7. The enclosure device of claim 6 wherein said first lashing site is disposed on said elongated back panel and said second lashing site is disposed on said elongated front panel, said strap thereby forming means for hand carrying the equipment.

8. The enclosure device of claim 2 wherein said first and second closure devices comprise first and second slider elements, respectively, for engaging said first and second closure devices, respectively said first and second slider elements being movable between first and second longitudinal origin points proximate said first latitudinal side, respectively, and first and second longitudinal termination points proximate said second latitudinal side, respectively.

9. The enclosure device of claim 8 wherein said first and second longitudinal termination points are located proximate to securing means for preventing selective access into said interior cavity, said securing means being fixedly attached to said enclosure element proximate said second latitudinal side of said elongated flap when said flap is in said closed position said first and second slider elements and said securing means each being adapted to receive interlock means for interconnecting said securing means with said first and second slider elements for preventing selective access into said interior cavity.

10. The enclosure device of claim 9 wherein said securing means comprises a third closure device for allowing selective enlargement of said elongated opening to provide enhanced access to said interior cavity of said enclosure, said third closure device originating at a third longitudinal origin point on said enclosure element and terminating at a third longitudinal termination point.

11. The enclosure device of claim 10 wherein said at least one lashing member is a strap detachably mounted to said enclosure element at a first lashing site proximate said first longitudinal side and attached to said enclosure element at a second lashing site on said enclosure device.

12. The enclosure device of claim 11 wherein said strap comprises means to support said enclosure at said first and second lashing sites for carrying the equipment by hand.

13. The enclosure device of claim 1 wherein said elongated flap portion is triangular in shape having first and second substantially isosceles sides and a base side; said first isosceles side being defined by a first closure device of said at least one closure device and said second isosceles side being defined by a second closure device of said at least one closure device; said elongated flap being fixably attached to said enclosure element at said base side so that said elongated flap can be moved to said open position while remaining fixedly attached to said enclosure device.

14. The enclosure device of claim 13 wherein said first and second closure devices comprise first and second slider elements, respectively, for engaging said first and second closure devices, respectively; said first and second slider elements being movable between first and second isosceles origin points proximate said base side, respectively, and first and second isosceles termination points proximate the corner formed by said first and second isosceles sides.

15. The enclosure device of claim 14 wherein said first and second isosceles termination points are located proximate to securing means fixedly attached to said enclosure element for preventing selective access into said interior cavity, said first and second slider elements and said securing means each being adapted to receive interlock means for interconnecting said securing means with said first and second slider elements for preventing selective access into said interior cavity.

16. The enclosure device of claim 1 further comprising weather barrier means for shielding the interior cavity of said enclosure elements from the weather.

17. The enclosure device of claim 16 wherein said weather barrier means comprises a covering for shielding said at least one closure device from the weather.

18. The enclosure device of claim 16 wherein said weather barrier means comprises said enclosure element fabricated out of weather resistent materials.

* * * * *